US009559413B2

(12) United States Patent
Katase et al.

(10) Patent No.: US 9,559,413 B2
(45) Date of Patent: Jan. 31, 2017

(54) ANTENNA POWER SUPPLY CIRCUIT

(71) Applicant: MITSUBISHI ELECTRIC CORPORATION, Chiyoda-ku (JP)

(72) Inventors: Tetsuya Katase, Chiyoda-ku (JP); Shuji Nuimura, Chiyoda-ku (JP); Tomohiro Mizuno, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 0 days.

(21) Appl. No.: 15/104,162

(22) PCT Filed: Dec. 16, 2014

(86) PCT No.: PCT/JP2014/083235
§ 371 (c)(1),
(2) Date: Jun. 13, 2016

(87) PCT Pub. No.: WO2015/093466
PCT Pub. Date: Jun. 25, 2015

(65) Prior Publication Data

US 2016/0315382 A1 Oct. 27, 2016

(30) Foreign Application Priority Data

Dec. 17, 2013 (JP) ..... 2013-259690

(51) Int. Cl.
*H01Q 1/50* (2006.01)

(52) U.S. Cl.
CPC ..... *H01Q 1/50* (2013.01)

(58) Field of Classification Search
CPC ..... H01Q 1/50
See application file for complete search history.

(56) References Cited

U.S. PATENT DOCUMENTS 6,373,445 B1 * 4/2002 Kuno ..... H01Q 19/132 343/781 R
8,013,784 B2 * 9/2011 Margomenos ..... G01S 7/032 342/175

(Continued)

FOREIGN PATENT DOCUMENTS

JP 30-4812 B1 7/1955
JP 3884725 B2 2/2007

(Continued)

OTHER PUBLICATIONS

International Search Report issued Mar. 17, 2015 for PCT/JP2014/083235 filed Dec. 16, 2014.

(Continued)

*Primary Examiner* — Trinh Dinh
(74) *Attorney, Agent, or Firm* — Oblon, McClelland, Maier & Neustadt, L.L.P.

(57) ABSTRACT

An antenna feed circuit includes: a first hybrid circuit having a reference phase second terminal and 90° lagging phase third terminal; second hybrid circuit having a first terminal connecting to first hybrid circuit second terminal, reference phase second terminal, and 90° lagging phase third terminal; a first polarization converter/second polarization converter pair outputting at second hybrid circuit second terminal phase; third polarization converter/fourth polarization converter pair outputting at second hybrid circuit third terminal phase; third hybrid circuit having a first terminal connecting to first hybrid circuit third terminal, reference phase second terminal, and 90° lagging phase third terminal; fifth polarization converter/sixth polarization converter pair outputting at third hybrid circuit third terminal phase; and seventh polarization converter/eighth polarization converter pair outputting at third hybrid circuit second terminal phase rotated by 180°.

12 Claims, 5 Drawing Sheets

(56) References Cited

U.S. PATENT DOCUMENTS

| | | | | |
|---|---|---|---|---|
| 2003/0164804 | A1* | 9/2003 | Chiba | H01Q 3/24 343/853 |
| 2004/0246062 | A1 | 12/2004 | Asao et al. | |

FOREIGN PATENT DOCUMENTS

| | | | |
|---|---|---|---|
| JP | 2009-27591 | A | 2/2009 |
| JP | 2013-85075 | A | 5/2013 |

OTHER PUBLICATIONS

H. Yukawa et al., "Downsized waveguide orthomode junction using phase shifters", The Institute of Electronics, Information and Communication Engineers, IEICE Technical Report, vol. 111, No, 3, MW2011-3, (Apr. 8, 2011), 7 pages.

Notification of Reasons for Rejection of JP 2015-524543 from Japan Patent Office issued on Jul. 7, 2015 with English Translation.

* cited by examiner

ANTENNA POWER SUPPLY CIRCUIT

TECHNICAL FIELD

The present disclosure relates to an antenna feed circuit for generation of a circularly polarized wave.

BACKGROUND ART

In Unexamined Japanese Patent Application Kokai Publication No. 2009-27591 (see Cited Reference 1), an antenna feed circuit is described that is equipped with an OMJ 101, filters 102*a* to 102*d* connected to respective branch waveguides 101*a* to 101*d*, phase shifters 103*a* and 104*a* for imparting a phase difference of 90° with respect to one another to the electromagnetic wave passing therethrough and connected to respective filters 102*a* and 102*b*, phase shifters 103*b* and 104*b* for imparting a phase difference of 90° with respect to one another to the electromagnetic wave passing therethrough and connected to respective filters 102*c* and 102*d*, a magic tee 105 connected to the phase shifters 103*a* and 104*a*, a magic tee 106 connected to the phase shifters 103*b* and 104*b*, an H-plane T-branch circuit 107 for combining electromagnetic waves output from the magic tees 105 and 106, and an E-plane T-branch circuit 108 for combining electromagnetic waves output from the magic tees 105 and 106.

CITATION LIST

Patent Literature

Patent Literature 1: Unexamined Japanese Patent Application Kokai Publication No. 2009-27591

Patent Literature 2: Japanese Patent No. 3884725

SUMMARY OF INVENTION

Technical Problem

The antenna feed circuit of Cited Reference 1 has a narrow band frequency characteristic by obtaining phase differences by use of phase shifters, and this results in a three-dimensional structure of the combining circuit due to use of a magic tee for combination, and increased size of the antenna feed circuit becomes a problem.

The aforementioned deficiency is the problem to be solved by the present disclosure, and the object of the present disclosure is to obtain an antenna feed circuit that has wide broadband frequency characteristics and can be made thin.

Solution to Problem

The antenna feed circuit of the present disclosure includes:

a first feed terminal;

a first waveguide-type hybrid circuit having a first waveguide-type hybrid circuit first terminal to connect to the first feed terminal, a first waveguide-type hybrid circuit second terminal to output a high frequency signal of a reference phase, and a first waveguide-type hybrid circuit third terminal to output a high frequency signal of 90° lagging phase from that of the high frequency signal of the second terminal at a transmission frequency;

a second waveguide-type hybrid circuit having a second waveguide-type hybrid circuit first terminal to connect to the second terminal of the first waveguide-type hybrid circuit, a second waveguide-type hybrid circuit second terminal to output the high frequency signal of the reference phase, and a second waveguide-type hybrid circuit third terminal to output the high frequency signal of 90° lagging phase from that of the high frequency signal of the second terminal at the transmission frequency;

a first waveguide-type polarization converter to receive as input the high frequency signal from the second waveguide-type hybrid circuit second terminal, and to output the high frequency signal at the transmission frequency with the polarization rotated by a first angle in one direction;

a second waveguide-type polarization converter to receive as input the high frequency signal from the first waveguide-type polarization converter, and to output the high frequency signal at the transmission frequency with the polarization rotated by the first angle in another direction, opposite to the one direction;

a third waveguide-type polarization converter to receive as input the high frequency signal from the second waveguide-type hybrid circuit third terminal, and to output the high frequency signal at the transmission frequency with the polarization rotated by a second angle in the one direction;

a fourth waveguide-type polarization converter to receive as input the high frequency signal from the third waveguide-type polarization converter, and to output the high frequency signal at the transmission frequency with the polarization rotated by the second angle in the other direction;

a third waveguide-type hybrid circuit having a third waveguide-type hybrid circuit first terminal to connect to the first waveguide-type hybrid circuit third terminal, a third waveguide-type hybrid circuit second terminal to output the high frequency signal of the reference phase, and a third waveguide-type hybrid circuit third terminal to output the high frequency signal of 90° lagging phase from that of the high frequency signal of the second terminal at the transmission frequency;

a fifth waveguide-type polarization converter to receive as input the high frequency signal from the third waveguide-type hybrid circuit third terminal, and to output the high frequency signal at the transmission frequency with the polarization rotated by a third angle in the one direction;

a sixth waveguide-type polarization converter to receive as input the high frequency signal from the fifth waveguide-type polarization converter, and to output the high frequency signal at the transmission frequency with the polarization rotated by the third angle in the other direction;

a seventh waveguide-type polarization converter to receive as input the high frequency signal from the third waveguide-type hybrid circuit second terminal, and to output the high frequency signal at the transmission frequency with the polarization rotated by a fourth angle in the other direction;

an eighth waveguide-type polarization converter to receive as input the high frequency signal from the seventh waveguide-type polarization converter, and to output the high frequency signal at the transmission frequency with the polarization rotated by an angle that is a difference between 180° and the fourth angle, in the other direction; and a main waveguide having:

a first branch terminal to receive as input the high frequency signal from the second waveguide-type polarization converter, a second branch terminal to receive as input the high frequency signal from the fourth waveguide-type polarization converter, a third branch terminal to receive as input the high frequency signal from the sixth waveguide-type polarization converter, and a fourth branch terminal to receive as input the high frequency signal from the eighth waveguide-type polarization converter, wherein the first branch terminal is adjacent to the second branch terminal and the fourth branch terminal, the second branch terminal is adjacent to the third branch terminal and the first branch terminal, the third branch terminal is adjacent to the fourth branch terminal and the second branch terminal, and the fourth branch terminal is adjacent to the first branch terminal and the third branch terminal.

Alternatively, the antenna feed circuit of the present disclosure includes:

a second feed terminal;

a fourth waveguide-type hybrid circuit having a fourth waveguide-type hybrid circuit first terminal to connect to the second feed terminal, a fourth waveguide-type hybrid circuit second terminal to output a high frequency signal of a reference phase, and a fourth waveguide-type hybrid circuit third terminal to output the high frequency signal of 90° lagging phase from that of the high frequency signal of the fourth waveguide-type hybrid circuit second terminal at a transmission frequency;

a third waveguide-type hybrid circuit having a third waveguide-type hybrid circuit fourth terminal to connect to the fourth waveguide-type hybrid circuit second terminal, a third waveguide-type hybrid circuit third terminal to output the high frequency signal of the reference phase, and a third waveguide-type hybrid circuit second terminal to output the high frequency signal of 90° lagging phase from that of the high frequency signal of the third waveguide-type hybrid circuit third terminal at the transmission frequency;

a fifth waveguide-type polarization converter to receive as input the high frequency signal from the third waveguide-type hybrid circuit third terminal, and to output the high frequency signal at the transmission frequency with the polarization rotated by a third angle in one direction;

a sixth waveguide-type polarization converter to receive as input the high frequency signal from the fifth waveguide-type polarization converter, and to output the high frequency signal at the transmission frequency with the polarization rotated by the third angle in another direction opposite to the one direction;

a seventh waveguide-type polarization converter to receive as input the high frequency signal from the third waveguide-type hybrid circuit second terminal, and to output the high frequency signal at the transmission frequency with the polarization rotated by a fourth angle in the other direction;

an eighth waveguide-type polarization converter to receive as input the high frequency signal from the seventh waveguide-type polarization converter, and to output the high frequency signal at the transmission frequency with the polarization rotated by an angle that is a difference between 180° and the fourth angle, in the other direction;

a second waveguide-type hybrid circuit having a second waveguide-type hybrid circuit fourth terminal to connect to the fourth waveguide-type hybrid circuit third terminal, a second waveguide-type hybrid circuit third terminal to output a high frequency signal of the reference phase, and a second waveguide-type hybrid circuit second terminal to output the high frequency signal of 90° lagging phase from that of the high frequency signal of the third terminal at the transmission frequency;

a first waveguide-type polarization converter to receive as input the high frequency signal from the second waveguide-type hybrid circuit second terminal, and to output the high frequency signal at the transmission frequency with the polarization rotated by a first angle in the one direction;

a second waveguide-type polarization converter to receive as input the high frequency signal from the first waveguide-type polarization converter, and to output the high frequency signal at the transmission frequency with the polarization rotated by the first angle in the other direction;

a third waveguide-type polarization converter to receive as input the high frequency signal from the second waveguide-type hybrid circuit third terminal, and to output the high frequency signal at the transmission frequency with the polarization rotated by a second angle in the one direction;

a fourth waveguide-type polarization converter to receive as input the high frequency signal from the third waveguide-type polarization converter, and to output the high frequency signal at the transmission frequency with the polarization rotated by the second angle in the other direction; and a main waveguide having:

a third branch terminal to receive as input the high frequency signal from the sixth waveguide-type polarization converter, a second branch terminal to receive as input the high frequency signal from the fourth waveguide-type polarization converter, a first branch terminal to receive as input the high frequency signal from the second waveguide-type polarization converter, and a fourth branch terminal to receive as input the high frequency signal from the eighth waveguide-type polarization converter, wherein the first branch terminal is adjacent to the second branch terminal and the fourth branch terminal, the second branch terminal is adjacent to the third branch terminal and the first branch terminal, the third branch terminal is adjacent to the fourth branch terminal and the second branch terminal, and the fourth branch terminal is adjacent to the first branch terminal and the third branch terminal.

Advantageous Effects of Invention

The antenna feed circuit of the present disclosure, by using waveguide-type hybrid circuits and waveguide-type polarization converters, obtains phase differences in the high frequency signals received as input by each branch terminal of a main waveguide, and thus a wideband frequency characteristic is obtained, structure of the waveguide becomes two dimensional, and thickness of the circuit can be reduced.

DESCRIPTION OF EMBODIMENTS

Embodiment 1

Figure 1:
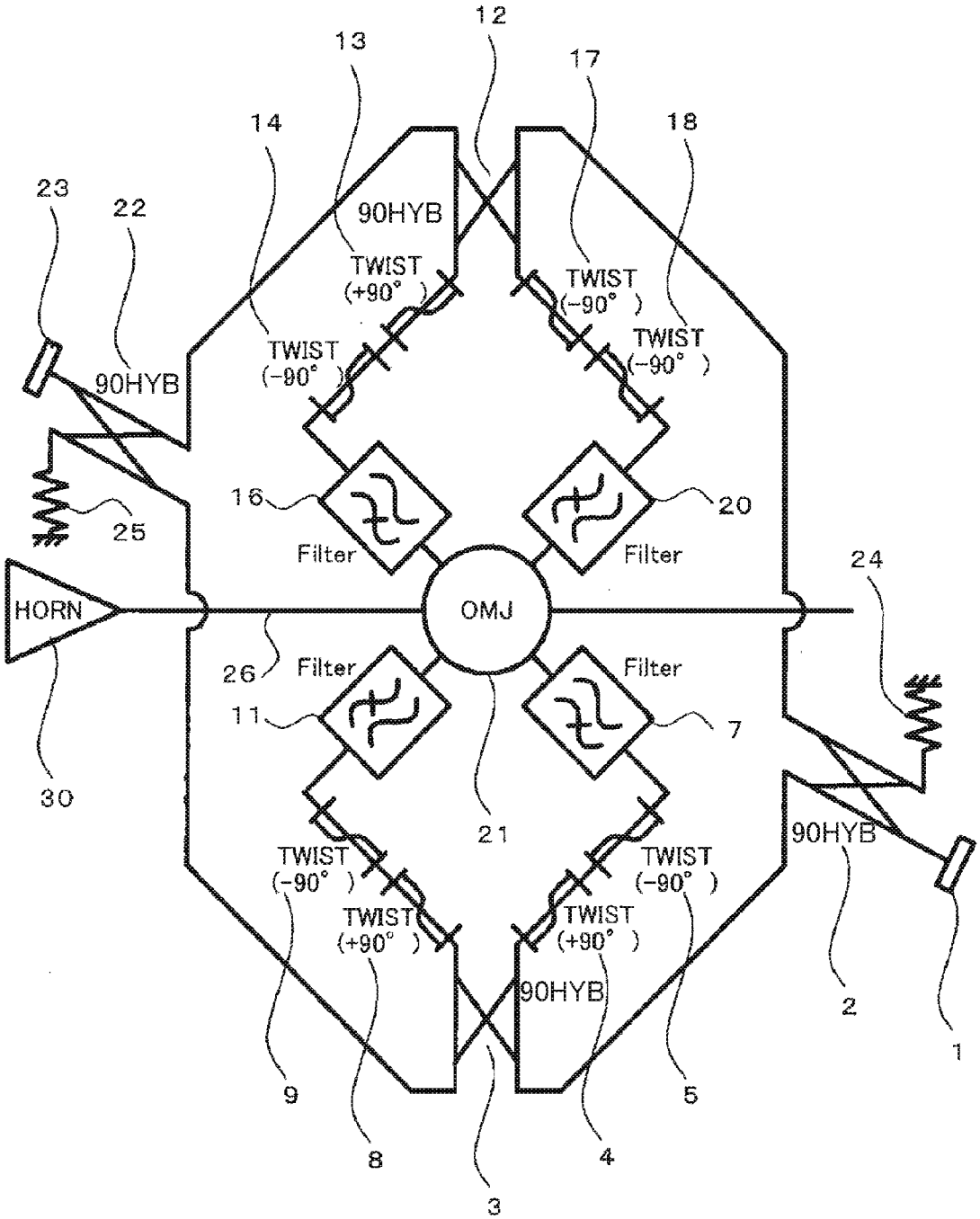
FIG. 1 is a circuit diagram of an antenna feed circuit according to Embodiment 1 of the present disclosure.
Figure 2:
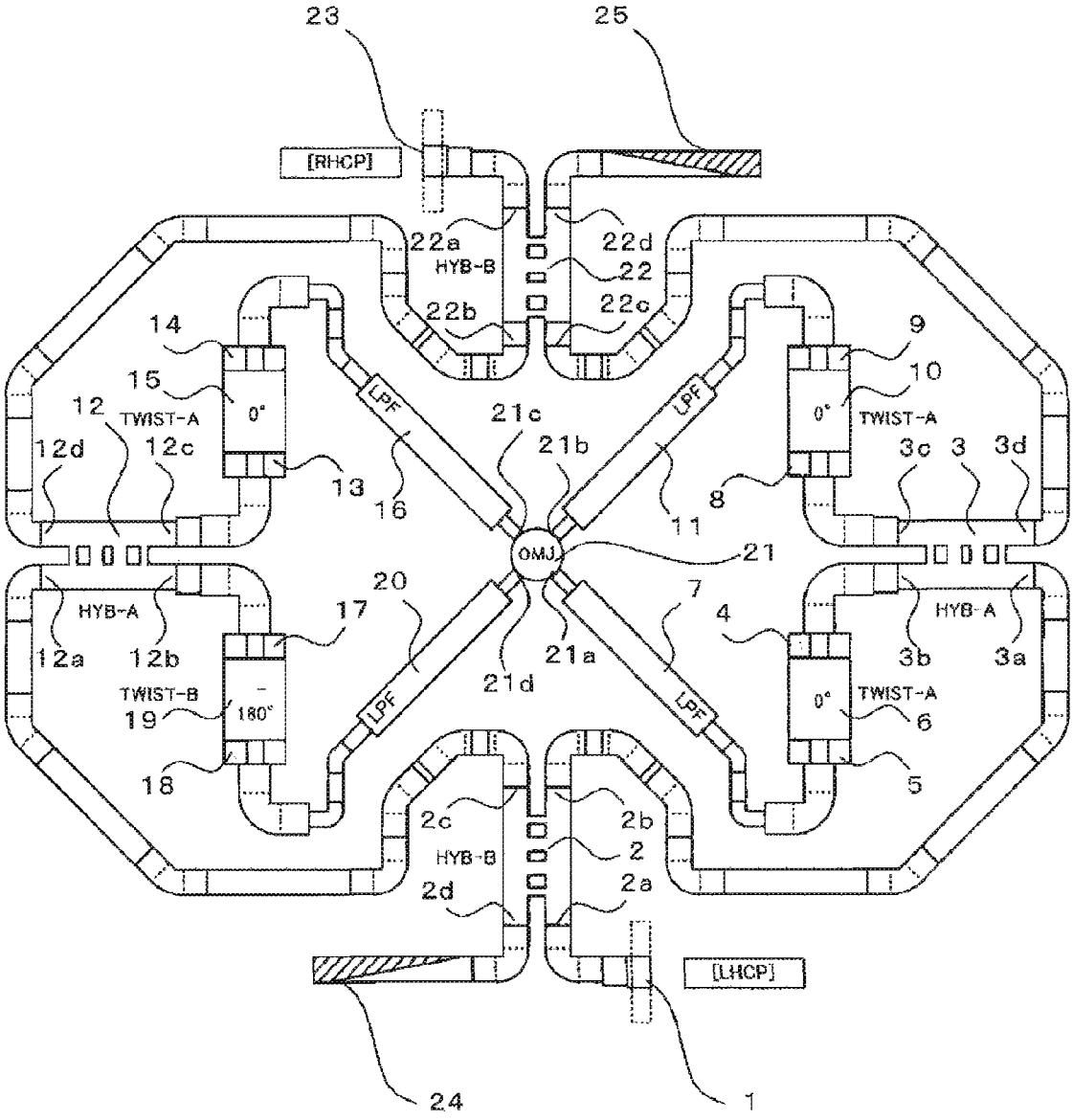
FIG. 2 is a configuration diagram of the antenna feed circuit according to Embodiment 1 of the present disclosure.

An antenna feed circuit according to Embodiment 1 of the present disclosure is described in reference to FIGS. 1 and 2. FIG. 1 is a circuit diagram of the antenna feed circuit according to Embodiment 1 of the present disclosure. FIG. 2 is a configuration diagram of the antenna feed circuit according to Embodiment 1 of the present disclosure. In FIGS. 1 and 2, the antenna feed circuit includes:

a first feed terminal 1;

a first waveguide-type hybrid circuit 2 to connect by a first terminal 2*a* to the first feed terminal 1, to output a high frequency signal of a reference phase from a second terminal 2*b*, and to output a high frequency signal from a third terminal 2*c* at a transmission frequency and at 90° lagging phase from that of the high frequency signal of the second terminal 2*b;* a second waveguide-type hybrid circuit 3 to connect by a first terminal 3*a* to the second terminal 2*b* of the first waveguide-type hybrid circuit 2, to output a high frequency signal of a reference phase from a second terminal 3*b*, and to output a high frequency signal from a third terminal 3*c* at a transmission frequency and at 90° lagging phase from that of the high frequency signal of the second terminal 3*b;* a first waveguide-type polarization converter 4 to receive as input the high frequency signal from the second terminal 3*b* of the second waveguide-type hybrid circuit 3, and to output a high frequency signal at the transmission frequency with the polarization rotated by 90° in one direction, such as the clockwise direction;

a second waveguide-type polarization converter 5 to receive as input the high frequency signal from the first waveguide-type polarization converter 4, and to output a high frequency signal at the transmission frequency with the polarization rotated by 90° in another direction, such as the counterclockwise direction, opposite to the one direction;

a waveguide 6 to connect to the first waveguide-type polarization converter 4 and the second waveguide-type polarization converter 5; and a waveguide-type low pass filter 7 to remove unnecessary waves of the high frequency signal output from the second waveguide-type polarization converter 5.

Also, the following are further provided:

a third waveguide-type polarization converter 8 to receive as input the high frequency signal from the third terminal 3*c* of the second waveguide-type hybrid circuit 3, and to output a high frequency signal at the transmission frequency with the polarization rotated by 90° in the one direction;

a fourth waveguide-type polarization converter 9 to receive as input the high frequency signal from the third waveguide-type polarization converter 8, and to output a high frequency signal at the transmission frequency with the polarization rotated by 90° in the other direction;

a waveguide 10 to connect to the third waveguide-type polarization converter 8 and the fourth waveguide-type polarization converter 9; and a waveguide-type low pass filter 11 removing an unnecessary wave of the high frequency signal output from the fourth waveguide-type polarization converter 9.

Also, the following are further provided:

a third waveguide-type hybrid circuit 12 to connect by a first terminal 12*a* to the third terminal 2*c* of the first waveguide-type hybrid circuit 2, to output from a second terminal 12*b* a high frequency signal of a reference phase, and to output from a third terminal 12*c* a high frequency signal at the transmission frequency at 90° lagging phase from that of the high frequency signal of the second terminal 12*b,* a fifth waveguide-type polarization converter 13 to receive as input the high frequency signal from the third terminal 12*c* of the third waveguide-type hybrid circuit 12, and to output a high frequency signal at the transmission frequency with the polarization rotated by 90° in the one direction;

a sixth waveguide-type polarization converter 14 to receive as input the high frequency signal from the fifth waveguide-type polarization converter 13, and to output a high frequency signal at the transmission frequency with the polarization rotated by 90° in the other direction;

a waveguide 15 to connect to the fifth waveguide-type polarization converter 13 and the sixth waveguide-type polarization converter 14; and a waveguide-type low pass filter 16 removing an unnecessary wave of the high frequency signal output from the sixth waveguide-type polarization converter 14.

Also, the following are further provided:

a seventh waveguide-type polarization converter 17 to receive as input the high frequency signal from the second terminal 12*b* of the third waveguide-type hybrid circuit 12, and to output a high frequency signal at the transmission frequency with the polarization rotated by 90° in the other direction;

an eighth waveguide-type polarization converter 18 to receive as input the high frequency signal from the seventh waveguide-type polarization converter 17, and to output a high frequency signal at the transmission frequency with the polarization rotated by 90° in the other direction;

a waveguide 19 to connect to the seventh waveguide-type polarization converter 17 and the eighth waveguide-type polarization converter 18; and a waveguide-type low pass filter 20 removing an unnecessary wave of the high frequency signal output from the eighth waveguide-type polarization converter 18.

A high frequency signal output from the waveguide-type low pass filter 7 enters a first branch terminal 21*a* of a waveguide group branching filter (OMJ) 21 included in a main waveguide 26, a high frequency signal output from the waveguide-type low pass filter 11 enters a second branch terminal 21*b* of the waveguide group branching filter (OMJ) 21, a high frequency signal output from the waveguide-type low pass filter 16 enters a third branch terminal 21*c* of the waveguide group branching filter (OMJ) 21, and a high frequency signal output from the waveguide-type low pass filter 20 enters a fourth branch terminal 21*d* of the waveguide group branching filter (OMJ) 21. The first branch terminal 21*a*, the second branch terminal 21*b*, the third branch terminal 21*c* and the fourth branch terminal 21*d* are arranged, in order, in the outer circumferential direction of the tube wall of the waveguide group branching filter (OMJ) 21 such that the phase difference between adjacent terminals becomes 90°. The branch terminals are arranged adjacent to one another, in order, as the first branch terminal 21*a*, the second branch terminal 21*b*, the third branch terminal 21*c*, the fourth branch terminal 21*d* and the first branch terminal 21*a*. A horn antenna 30, through the main waveguide 26, is connected to the waveguide group branching filter (OMJ) 21.

A fourth terminal 12*d* of the third waveguide-type hybrid circuit 12 is connected to the second terminal 22*b*, which is a reference phase high frequency signal output terminal of the fourth waveguide-type hybrid circuit 22; and a fourth terminal 3*d* of the second waveguide-type hybrid circuit 3 is connected to the third terminal 22*c* of the fourth waveguide-type hybrid circuit 22 and outputs a high frequency signal at the transmission frequency at 90° lagging phase from that of the high frequency signal of the second terminal 22*b*. A first terminal 22*a* of the fourth waveguide-type hybrid circuit 22 is connected to a second feed terminal 23, which is an additional power feed terminal.

The mechanical dimensions in the transmission direction of the high frequency signal in the first waveguide-type hybrid circuit 2, second waveguide-type hybrid circuit 3, third waveguide-type hybrid circuit 12 and fourth waveguide-type hybrid circuit 22 are the same, and preferably the same waveguide-type hybrid circuit is used. Mechanical dimensions in the transmission direction of the high frequency signal in the first waveguide-type polarization converter 4, second waveguide-type polarization converter 5, third waveguide-type polarization converter 8, fourth waveguide-type polarization converter 9, fifth waveguide-type polarization converter 13, sixth waveguide-type polarization converter 14, seventh waveguide-type polarization converter 17 and eighth waveguide-type polarization converter 18 are the same, and a waveguide-type polarization converter is used such as a waveguide-type polarization converter described in Japanese Patent No. 3884725 (see Patent Literature 2), a twist waveguide and the like.

A terminating resistor 24 is connected to the fourth terminal 2*d* of the first waveguide-type hybrid circuit 2, and a terminating resistor 5 is connected to the fourth terminal 22*d* of the fourth waveguide-type hybrid circuit 22.

Operation of the antenna feed circuit of Embodiment 1 of the present disclosure is explained below. Although phase relationships, such as reference phase, lagging phase and the like of high frequency signals are described in the explanation of operation, the description concerns phase relationships of the high frequency signal at the transmission frequency.

The high frequency signal input from the first feed terminal 1 is received as input by the first terminal 2*a* of the first waveguide-type hybrid circuit 2, and is output from the second terminal 2*b* at the reference phase and output from the third terminal 2*c* with 90° lagging phase. The high frequency signal output at the reference phase from the second terminal 2*b* is received as input by the first terminal 3*a* of the second waveguide-type hybrid circuit 3, and is output from the second terminal 3*b* at the reference phase and output from the third terminal 3*c* with 90° lagging phase.

The high frequency signal output at the reference phase from the second terminal 3*b* of the second waveguide-type hybrid circuit 3 is received as input by the first waveguide-type polarization converter 4, the polarized wave is output with the polarization rotated by 90° in one direction by the first waveguide-type polarization converter 4, the output high frequency signal is received as input by the second waveguide-type polarization converter 5 through the waveguide 6, the polarized wave is output with the polarization rotated by 90° in another direction opposite to the one direction by the second waveguide-type polarization converter 5, thereby returning to the polarization of the input to the first waveguide-type polarization converter 4 and outputting at the reference phase. Rotation of the polarization by 90° by the waveguide-type polarization converters in Embodiment 1 of the present disclosure means orthogonal rotation of the polarization of the high frequency signal from a horizontal polarization to a vertical polarization. If rotation of the polarization in the clockwise direction is defined, for example, to be rotation in the "one direction", then rotation of the polarization in the opposite direction (counterclockwise direction) is defined to be rotation in the "other direction".

The high frequency signal of the reference phase is output from the second waveguide-type polarization converter 5, harmonics of the high frequencies are removed by the waveguide-type low pass filter 7, and then the filtered high frequency signal enters a first branch terminal 21*a* of the OMJ 21.

The high frequency signal having a lagging phase of 90° output from the third terminal 3*c* of the second waveguide-type hybrid circuit 3 is received as input by the third waveguide-type polarization converter 8, is output with the polarization rotated 90° in the one direction by the third waveguide-type polarization converter 8, enters the fourth waveguide-type polarization converter 9 through the waveguide 10, and is output with the polarization rotated 90° in the other direction by the fourth waveguide-type polarization converter 9 so as to return to the high frequency signal having the polarization that was the polarization of the input to the third waveguide-type polarization converter 8 and to be output at the 90° lagging phase.

The high frequency signal having the 90° lagging phase output from the fourth waveguide-type polarization converter 9, after harmonics thereof are removed by the waveguide-type low pass filter 11, enter the second branch terminal 21*b* of the OMJ 21.

The high frequency signal having the 90° lagging phase output from the third terminal 2*c* of the first waveguide-type hybrid circuit 2 enters the first terminal 12*a* of the third waveguide-type hybrid circuit 12, with the 90° lagging phase from the second terminal 12*b*, is further lagged in phase by 90°, and is thus output from the third terminal 12*c* with a 180° lagging phase.

The high frequency signal having the 180° lagging phase output from the third terminal 12*c* of the third waveguide-type hybrid circuit 12 enters the fifth waveguide-type polarization converter 13, is output with the polarization rotated 90° in the one direction by the fifth waveguide-type polarization converter 13, and enters the sixth waveguide-type polarization converter 14 through the waveguide 15, and the polarization is rotated by 90° in the other direction by the sixth waveguide-type polarization converter 14, so as to return to high frequency signal having the polarization that was the polarization of the input to the fifth waveguide-type polarization converter 13 and to be output with the 180° lagging phase.

After harmonics are removed by the waveguide-type low pass filter 16 from the high frequency signal having the 180° lagging phase output from the sixth waveguide-type polarization converter 14, the resultant high frequency signal enters the third branch terminal 21*c* of the OMJ 21.

The high frequency signal having the 90° lagging phase output from the second terminal 12*b* of the third waveguide-type hybrid circuit 12 enters the seventh waveguide-type polarization converter 17, is output with the polarization rotated by 90° in the other direction by the seventh waveguide-type polarization converter 17, enters the eighth waveguide-type polarization converter 18 through the waveguide 19, and is further rotated by 90° in the other direction by the eighth waveguide-type polarization converter 18, so that the resultant polarization has 180° symmetry relative to the polarization of the high frequency signal that entered seventh waveguide-type polarization converter 17, and thus the output high frequency signal has a 270° lagging phase.

The high frequency signal having the 270° lagging phase output from the eighth waveguide-type polarization converter 18, after removal of harmonics of the high frequency signal by the waveguide-type low pass filter 20, enters the fourth branch terminal 21*d* of the OMJ 21.

The high frequency signals having progressively 90° lagging phase, in order, as the signals entering the first branch terminal 21*a*, the second branch terminal 21*b*, the third branch terminal 21*c* and the fourth branch terminal 21*d* of the OMJ 21, enter the OMJ 21, and thus a circularly polarized wave is generated by the OMJ 21. Phase lags in the counterclockwise direction in FIG. 2, and thus as viewed from the plane of the paper, a counterclockwise circularly polarized wave is generated.

When the high frequency signal enters the second feed terminal 23, by similar operation, the high frequency signal of the reference phase enters the third branch terminal 21*c*, the high frequency signal at 90° lagging phase enters the second branch terminal 21*b*, the high frequency signal at 180° lagging phase enters the first branch terminal 21*a*, and the high frequency signal at 270° lagging phase enters the fourth branch terminal 21*d* of the OMJ 21. Due to the high frequency signals entering the OMJ 21, phase becomes lagged in the clockwise direction as seen in FIG. 2, and a circularly polarized wave is generated with clockwise circular polarization.

The operation of generating the circularly polarized wave with clockwise circular polarization is explained below. The high frequency signal input from the second feed terminal 23 enters the first terminal 22*a* of the fourth waveguide-type hybrid circuit 22, is output from the second terminal 22*b* at the reference phase, and is output from the third terminal 22*c* with a 90° lagging phase. The high frequency signal output at the reference phase from the second terminal 22*b* enters the fourth terminal 12*d* of the third waveguide-type hybrid circuit 12, is output from the third terminal 12*c* at the reference phase, and is output from the second terminal 12*b* with a 90° lagging phase.

The high frequency signal output at the reference phase from the third terminal 12*c* of the third waveguide-type hybrid circuit 12 enters the fifth waveguide-type polarization converter 13, is output with the polarization rotated by 90 degrees in the one direction by the fifth waveguide-type polarization converter 13, enters the sixth waveguide-type polarization converter 14 through the waveguide 15, and the polarization is rotated by 90° in the other direction by the sixth waveguide-type polarization converter 14, so as to return to the polarization of the input to the fifth waveguide-type polarization converter 13, and the high frequency signal is output at the reference phase.

The harmonics of the high frequency signal at the reference phase output from the sixth waveguide-type polarization converter 14 are removed by the waveguide-type low pass filter 16, and the resultant high frequency signal enters the third branch terminal 21*c* of the OMJ 21.

The high frequency signal output at with the 90° lagging phase from the second terminal 12*b* of the third waveguide-type hybrid circuit 12 enters the seventh waveguide-type polarization converter 17, is output with the polarization rotated by 90° in the other direction by the seventh waveguide-type polarization converter 17, enters the eighth waveguide-type polarization converter 18 through the waveguide 19, and is rotated further by 90° in the other direction by the eighth waveguide-type polarization converter 18, resulting in a polarization that has 180° symmetry relative to the high frequency signal entering the eighth waveguide-type polarization converter 17, and thus the high frequency signal is output at 270° lagging phase.

After removal of the harmonics by the waveguide-type low pass filter 20 from the high frequency signal at 270° lagging phase output from the eighth waveguide-type polarization converter 18, the high frequency signal enters the fourth branch terminal 21*d* of the OMJ 21.

The high frequency signal having the 90° lagging phase output from the third terminal 22*c* of the fourth waveguide-type hybrid circuit 22 enters the fourth terminal 3*d* of the second waveguide-type hybrid circuit 3, and is output at the same 90° lagging phase from the third terminal 3*c*, the high frequency signal is further lagged in phase by 90°, so that the high frequency signal at 180° lagging phase is output from the second terminal 3*b*.

The high frequency signal at the 180° lagging phase output from the second terminal 3*b* of the second waveguide-type hybrid circuit 3 enters the first waveguide-type polarization converter 4, is output with the polarization rotated by 90° in the one direction by the first waveguide-type polarization converter 4, enters the second waveguide-type polarization converter 5 through the waveguide 6, and is output with the polarization rotated by 90° in the other direction by the second waveguide-type polarization converter 5, so that the polarization returns to that of the input to the first waveguide-type polarization converter 4, and the high frequency signal is output at the same 180° lagging phase.

After removal of the harmonics by the waveguide-type low pass filter 7 from the high frequency signal at the 180° lagging phase output from the second waveguide-type polarization converter 5, the high frequency signal enters the first branch terminal 21*a* of the OMJ 21.

The high frequency signal at the 90° lagging phase output from the third terminal 3*c* of the second waveguide-type hybrid circuit 3 enters the third waveguide-type polarization converter 8, is output with the polarization rotated by 90° in the one direction by the third waveguide-type polarization converter 8, enters the fourth waveguide-type polarization converter 9 through the waveguide 10, and is output with the polarization rotated by 90° in the other direction by the fourth waveguide-type polarization converter 9, so that the polarization returns to that of the input to the third waveguide-type polarization converter 8, and the high frequency signal is output with the same 90° lagging phase.

After removal of the harmonics by the waveguide-type low pass filter 11 from the high frequency signal having the 90° lagging phase output from the fourth waveguide-type polarization converter 9, the high frequency signal enters the second branch terminal 21*b* of the OMJ 21.

The high frequency signals having progressively 90° lagging phase, in order, as the signals entering the third branch terminal 21*c*, the second branch terminal 21*b*, the first branch terminal 21*a* and the fourth branch terminal of the OMJ 21, enter the OMJ 21, and thus a circularly polarized wave is generated by the OMJ 21. Phase lags in the clockwise direction in FIG. 2, and thus as viewed from the plane of the paper, a clockwise circularly polarized wave is generated.

The antenna feed circuit according to Embodiment 1 of the present disclosure, rather than enabling change of phase of the high frequency signal using phase shifters, enables rotation of the polarization of the high frequency signal by use of waveguide-type polarization converters such as the waveguide-type polarization converter described in Japanese Patent No. 3884725, twist waveguide and the like. Thus the antenna feed circuit of Embodiment 1 is advantageous due to wide band frequency characteristic of the high frequency signal in comparison to the configuration using phase shifters. Moreover, due to configuration using waveguide-type hybrid circuits and waveguide-type polarization converters, the antenna feed circuit is two-dimensional and has the advantage of enabling reduction of thickness of the antenna feed circuit.

The antenna feed circuit of Embodiment 1 of the present disclosure is configured using the first through fourth waveguide-type hybrid circuits, the first through eighth waveguide-type polarization converters, the waveguide-type low pass filters and the waveguides, which are passive components. Therefore reverse operation is possible, and when a clockwise circularly polarized wave high frequency signal enters the OMJ 21, the high frequency signal is output from the second feed terminal, and when a counterclockwise circularly polarized wave high frequency signal enters the OMJ 21, the high frequency signal is output from the first feed terminal.

For the antenna feed circuit according to Embodiment 1 of the present disclosure, in order to make the polarization of the high frequency signal entering the first waveguide-type polarization converter 4 become equivalent to the polarization of the high frequency signal output from the second waveguide-type polarization converter 5, as long as the polarization rotation direction of the first waveguide-type polarization converter 4 is the reverse of the polarization rotation direction of the second waveguide-type polarization converter 5, the sequence of rotations may begin with either clockwise rotation or counterclockwise rotation. The relationship of rotation direction of the polarization of the high frequency signals of the third waveguide-type polarization converter 8 and the fourth waveguide-type polarization converter 9 is similar to the relationship of rotation direction of the polarization of the high frequency signals of the fifth waveguide-type polarization converter 13 and the sixth waveguide-type polarization converter 14.

Concerning the relationship between the seventh waveguide-type polarization converter 17 and eighth waveguide-type polarization converter 18, the rotation direction can be either clockwise or counterclockwise, as long as the polarization of the eighth waveguide-type polarization converter 18 has the same direction of rotation of the polarization of the seventh waveguide-type polarization converter 17 such that the polarization of the high frequency signal output from the eighth waveguide-type polarization converter 18 has rotation 180° opposite to the polarization of the high frequency signal entering the seventh waveguide-type polarization converter 17.

Embodiment 2

In Embodiment 1 of the present disclosure, a circularly polarized wave is generated by feeding the high frequency signal phase lagged in increments of 90° into the OMJ 21 arranged in the main waveguide. However, the circularly polarized wave may also be generated by arranging an orthogonal polarized wave separator (OMT), rather than the OMJ 21, in the main waveguide, and receiving as input the high frequency signal to the OMT phase lagged in increments of 90°.

Figure 3:
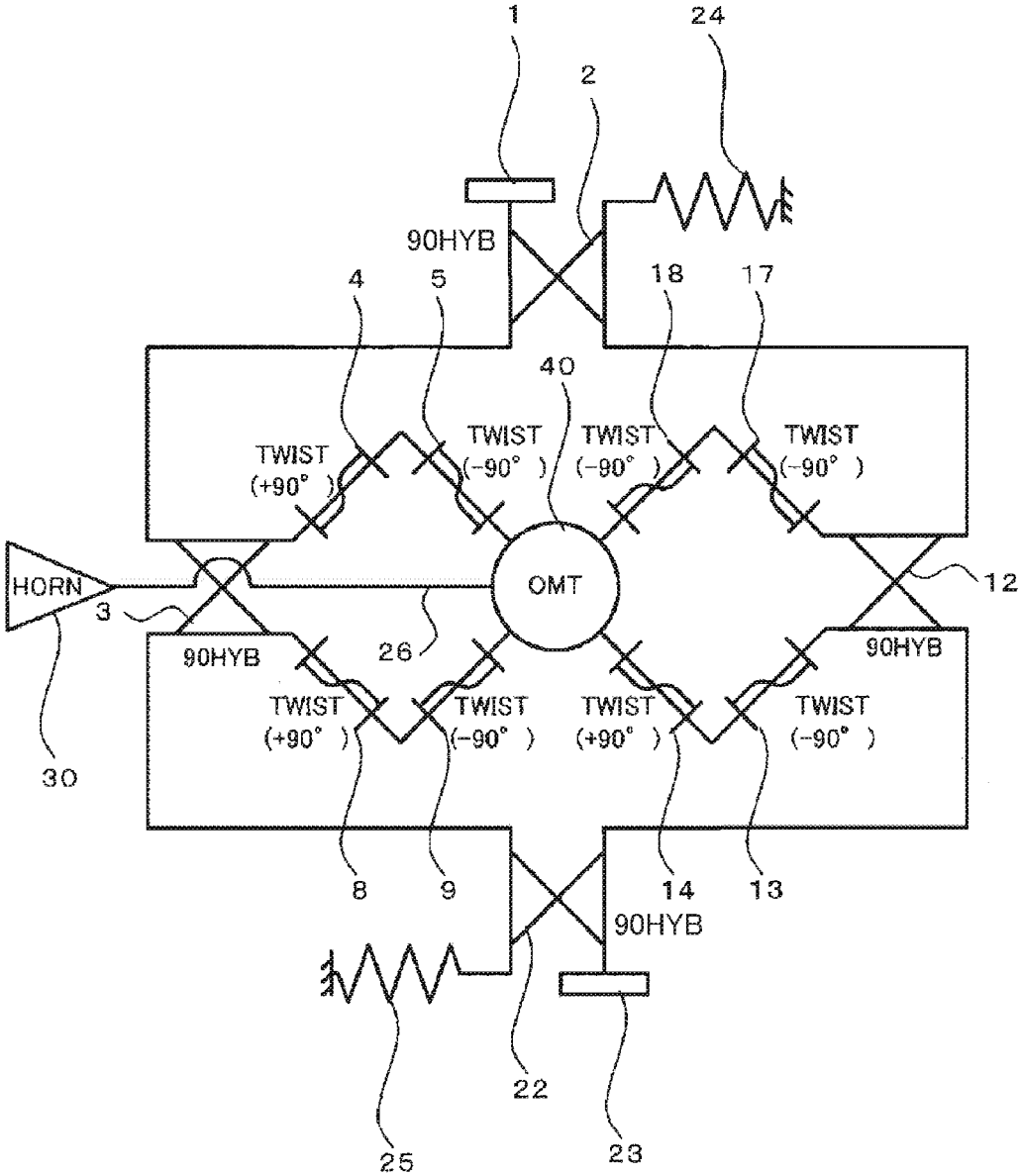
FIG. 3 is a circuit diagram of an antenna feed circuit according to Embodiment 2 of the present disclosure.
Figure 4:
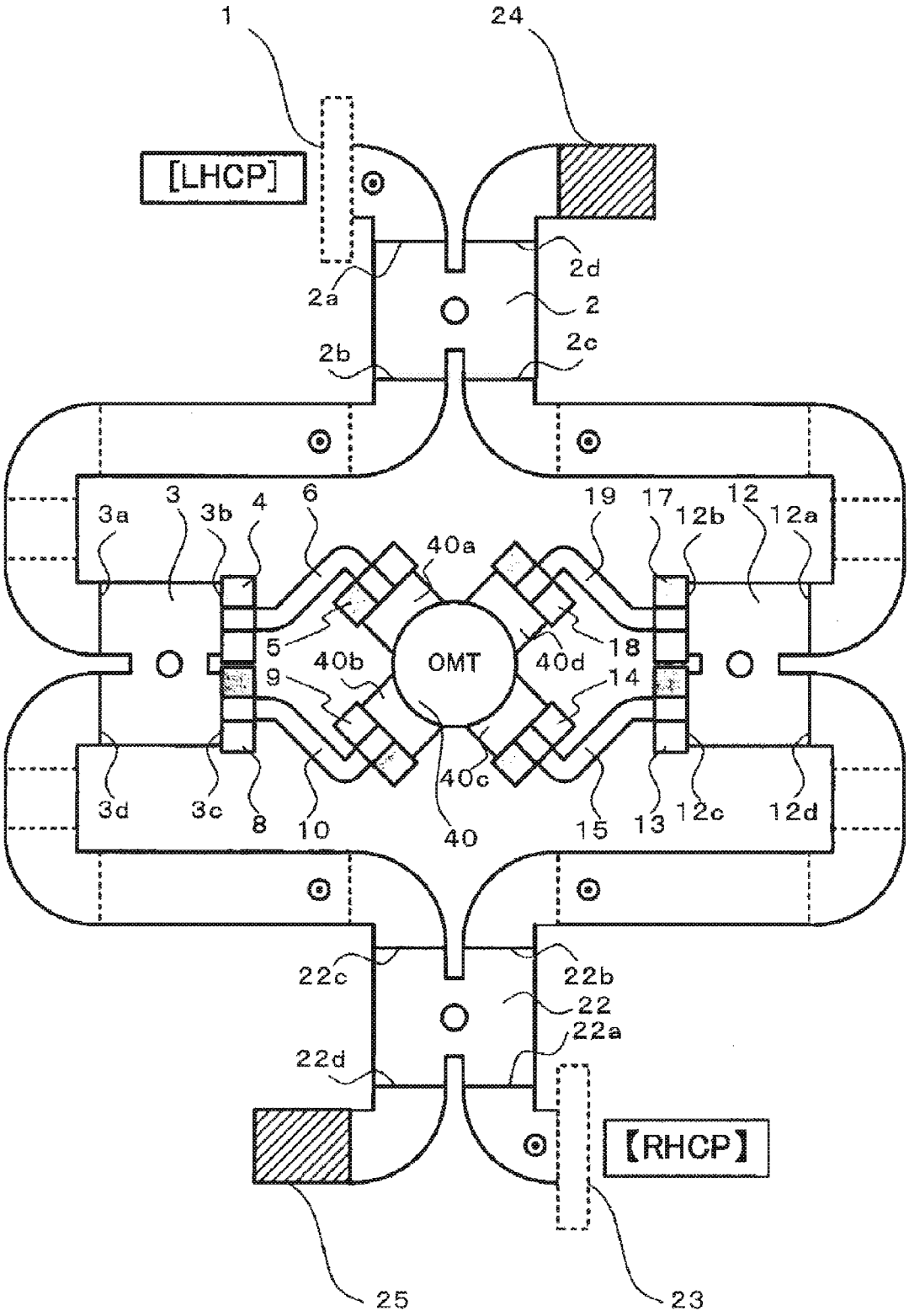
FIG. 4 is a configuration diagram of the antenna feed circuit according to Embodiment 2 of the present disclosure.

An antenna feed circuit of Embodiment 2 of the present disclosure is described with reference to FIGS. 3 and 4. In FIGS. 3 and 4, constituent elements that are the same or equivalent to those of FIGS. 1 and 2 are assigned the same reference signs, and description of such elements is omitted.

In the antenna feed circuit of Embodiment 2 of the present disclosure, the waveguide-type low pass filter 7, waveguide-type low pass filter 11, waveguide-type low pass filter 16 and waveguide-type low pass filter 20 from the antenna feed circuit of Embodiment 1 of the present disclosure are omitted, and an orthogonal polarized wave separator (OMT) 40 is arranged in the main waveguide 26 in place of the waveguide group branching filter (OMJ) 21.

Thus the high frequency signal output from the second waveguide-type polarization converter 5 enters the first branch terminal 40*a* of the orthogonal polarized wave separator (OMT) 40 arranged in the main waveguide 26, the high frequency signal output from the fourth waveguide-type polarization converter 9 enters the second branch terminal 40*b* of the orthogonal polarized wave separator (OMT) 40, the high frequency signal output from the sixth waveguide-type polarization converter 14 enters the third branch terminal 40*c* of the orthogonal polarized wave separator (OMT) 40, and the high frequency signal output from the eighth waveguide-type polarization converter 18 enters the fourth branch terminal 40*d* of the orthogonal polarized wave separator (OMT) 40. The first branch terminal 40*a*, second branch terminal 40*b*, third branch terminal 40*c* and fourth branch terminal 40*d* are arranged at the orthogonal polarized wave separator (OMT) 40 so that the phase differences between adjacent terminals become 90°. Furthermore, the branch terminals are arranged adjacent to each other, in order, as the first branch terminal 40*a*, second branch terminal 40*b*, third branch terminal 40*c*, fourth branch terminal 40*d*, and first branch terminal 40*a*. The horn antenna 30 is connected through the main waveguide 26 to the orthogonal polarized wave separator (OMT) 40.

Operation of the antenna feed circuit of Embodiment 2 of the present disclosure is described below. Although phase relationships of high frequency signals, such as reference phase, lagging phase and the like, are described in the explanation of operation, the description concerns phase relationships that are all of the high frequency signals at the transmission frequency.

The high frequency signal input from the first feed terminal 1 enters the first terminal 2*a* of the first waveguide-type hybrid circuit 2, and is output respectively at the reference phase from the second terminal 2*b*, and at 90° lagging phase from the third terminal 2*c*. The high frequency signal output at the reference phase from the second terminal 2*b* enters the first terminal 3*a* of the second waveguide-type hybrid circuit 3, and is output respectively at the reference phase from the second terminal 3*b* and at 90° lagging phase from the third terminal 3*c*.

The high frequency signal output at the reference phase from the second terminal 3*b* of the second waveguide-type hybrid circuit 3 enters the first waveguide-type polarization converter 4, from which the polarized wave is output with the polarization rotated by 90° in the one direction by the first waveguide-type polarization converter 4, and enters the second waveguide-type polarization converter 5 through the waveguide 6, and the polarization is rotated by the second waveguide-type polarization converter 5 by 90° in the other direction opposite to the one direction, and thus phase of the polarization returns to that entering the first waveguide-type polarization converter 4, and the high frequency signal is output at the reference phase. The rotation of the polarization by 90° by the waveguide-type polarization converters in Embodiment 1 of the present disclosure means orthogonal rotation of the polarization of the high frequency signal from a horizontal polarization to a vertical polarization. Rotation in the one direction and rotation in the other direction are defined, for example, such that propagation of the high frequency signal is taken to be rotated in the one direction by clockwise rotation, and is taken to be rotated in the other direction by counterclockwise rotation.

The high frequency signal of the reference phase output from the second waveguide-type polarization converter 5 enters the first branch terminal 40*a* of the OMT 40.

The high frequency signal output at 90° lagging phase output from the third terminal 3*c* of the second waveguide-type hybrid circuit 3 enters the third waveguide-type polarization converter 8, from which the polarized wave is output with the polarization rotated by 90° in the one direction by the third waveguide-type polarization converter 8, and enters the fourth waveguide-type polarization converter 9 through the waveguide 10. The high frequency signal polarization is rotated by 90° in the other direction by the fourth waveguide-type polarization converter 9, and thus polarization returns to that of the input to the third waveguide-type polarization converter 8, and is output at the same 90° lagging phase.

The high frequency signal at the 90° lagging phase output from the fourth waveguide-type polarization converter 9 enters the second branch terminal 40*b* of the OMT 40.

The high frequency signal having the 90° lagging phase output from the third terminal 2*c* of the first waveguide-type hybrid circuit 2 enters the first terminal 12*a* of the third waveguide-type hybrid circuit 12, is output at the same 90° lagging phase from the second terminal 12*b* and is output from the third terminal 12*c* further lagged in phase by 90°, that is to say, is output at 180° lagging phase.

The high frequency signal at the 180° lagging phase output from the third terminal 12*c* of the third waveguide-type hybrid circuit 12 enters the fifth waveguide-type polarization converter 13, is output after rotation of the polarization by 90° in the one direction by the fifth waveguide-type polarization converter 13, and enters the sixth waveguide-type polarization converter 14 through the waveguide 15, and the polarization is rotated by 90° in the other direction by the sixth waveguide-type polarization converter 14, which returns the polarization to the polarization of the input to the fifth waveguide-type polarization converter 13, so that the high frequency signal is output at the same 180° lagging phase.

The high frequency signal at the 180° lagging phase output from the sixth waveguide-type polarization converter 14 enters the third branch terminal 40*c* of the OMT 40.

The high frequency signal at the 90° lagging phase output from the second terminal 12*b* of the third waveguide-type hybrid circuit 12 enters the seventh waveguide-type polarization converter 17, is output after rotation of the polarization by 90° in the other direction by the seventh waveguide-type polarization converter 17, and enters the eighth waveguide-type polarization converter 18 through the waveguide 19, and the polarization is further rotated by 90° in the other direction by the eighth waveguide-type polarization converter 18, which makes the polarization 180° opposite in polarization to that of the input to the seventh waveguide-type polarization converter 17, so that the high frequency signal is output at 270° lagging phase.

The high frequency signal at the 270° lagging phase output from the eighth waveguide-type polarization converter 18 enters the fourth branch terminal 40*d* of the OMT 40.

The high frequency signals having progressively 90° lagging phase, in order, as the signals entering the first branch terminal 40*a*, the second branch terminal 40*b*, the third branch terminal 40*c* and the fourth branch terminal 40*d* of the OMT 40, enter the OMT 40, and thus a circularly polarized wave is generated by the OMT 40. Phase lags in the counterclockwise direction in FIG. 4, and thus as viewed from the plane of the paper, a counterclockwise circularly polarized wave is generated.

When the high frequency signal enters the second feed terminal 23, by similar operation, the high frequency signal of the reference phase entering the third branch terminal 40*c* of the OMT 40, the high frequency signal at the 90° lagging phase entering the second branch terminal 40*b*, the high frequency signal at the 180° lagging phase entering the first branch terminal 40*a*, and the high frequency signal at the 270° lagging phase entering the fourth branch terminal 40*d* enter the OMT 40. Thus phase lags in the clockwise direction in FIG. 4, and therefore as viewed from the plane of the paper, a clockwise circularly polarized wave is generated.

Operation to generate the clockwise circularly polarized wave is described below. The high frequency signal input from the second feed terminal 23 enters the first terminal 22*a* of the fourth waveguide-type hybrid circuit 22, and is output respectively at the reference phase from the second terminal 22*b* and at 90° lagging phase from the third terminal 22*c*. The high frequency signal output at the reference phase from the second terminal 22*b* enters the fourth terminal 12*d* of the third waveguide-type hybrid circuit 12, and is output respectively from the third terminal 12*c* at the reference phase and from the second terminal 12*b* at 90° lagging phase.

The high frequency signal output at the reference phase from the third terminal 12*c* of the third waveguide-type hybrid circuit 12 enters the fifth waveguide-type polarization converter 13, is output with the polarization rotated by 90° in the one direction by the fifth waveguide-type polarization converter 13, enters the sixth waveguide-type polarization converter 14 through the waveguide 15, and has the polarization rotated 90° in the other direction by the sixth waveguide-type polarization converter 14, so that the polarization returns to that of the input to the fifth waveguide-type polarization converter 13, and the high frequency signal is output at the reference phase.

The high frequency signal of the reference phase output from the sixth waveguide-type polarization converter 14 enters the third branch terminal 40*c* of the OMT 40.

The high frequency signal at the 90° lagging phase output from the second terminal 12*b* of the third waveguide-type hybrid circuit 12 enters the seventh waveguide-type polarization converter 17, is output after rotation of the polarization by 90° in the other direction by the seventh waveguide-type polarization converter 17, and enters the eighth waveguide-type polarization converter 18 through the waveguide 19, and the polarization is further rotated by 90° in the other direction by the eighth waveguide-type polarization converter 18, so that the resultant polarization is 180° opposite to the polarization of the input to the seventh waveguide-type polarization converter 17, and thus the high frequency signal is output at 270° lagging phase.

The high frequency signal at the 270° lagging phase output from the eighth waveguide-type polarization converter 18 enters the fourth branch terminal 40*d* of the OMT 40.

The high frequency signal output at the 90° lagging phase from the third terminal 22*c* of the fourth waveguide-type hybrid circuit 22 enters the fourth terminal 3*d* of the second waveguide-type hybrid circuit 3, is output at the same 90° lagging polarization phase from the third terminal 3*c*, and is output from the second terminal 3*b* further lagged in phase by 90°, that is to say, is output at 180° lagging phase.

The high frequency signal at the 180° lagging phase output from the second terminal 3*b* of the second waveguide-type hybrid circuit 3 enters the first waveguide-type polarization converter 4, is output after rotation of the polarization by 90° in the one direction by the first waveguide-type polarization converter 4, and enters the second waveguide-type polarization converter 5 through the waveguide 6, and the second waveguide-type polarization converter 5 rotates the polarization by 90° in the other direction to return to the input polarization of the first waveguide-type polarization converter 4, and the high frequency signal is output at 180° lagging phase.

The high frequency signal at the 180° lagging phase output from the second waveguide-type polarization converter 5 enters the first branch terminal 40*a* of the OMT 40.

The high frequency signal at the 90° lagging phase output from the third terminal 3*c* of the second waveguide-type hybrid circuit 3 enters the third waveguide-type polarization converter 8, is output after rotation of the polarization by 90° in the one direction by the third waveguide-type polarization converter 8, and enters the fourth waveguide-type polarization converter 9 through the waveguide 10, and the polarization is rotated by 90° in the other direction by the fourth waveguide-type polarization converter 9, so that the resultant polarization returns to the polarization of the input to the third waveguide-type polarization converter 8, and thus the high frequency signal is output at the same 90° lagging phase.

The high frequency signal at the 90° lagging phase output from the fourth waveguide-type polarization converter 9 enters the second branch terminal 40*b* of the OMT 40.

The high frequency signals having progressively incremented 90° lagging phase, in order, as the signals entering the third branch terminal 40*c*, the second branch terminal 40*b*, the first branch terminal 40*a* and the fourth branch terminal 40*d* of the OMT 40, enter the OMT 40, and thus a circularly polarized wave is generated by the OMT 40. Phase lags in the clockwise direction in FIG. 4, and thus as viewed from the plane of the paper, a clockwise circularly polarized wave is generated.

Without phase shifting of the high frequency signal by use of phase shifters, the antenna feed circuit of Embodiment 2 of the present disclosure causes rotation of the polarization of the high frequency signal by use of waveguide-type polarization converters such as the waveguide-type polarization converter described in Japanese Patent No. 3884725, twist waveguide and the like, and thus the antenna feed circuit is advantageous in that the frequency characteristic of the high frequency signal has a wider band region than that of the configuration using phase shifters. Moreover, due to configuration using waveguide-type hybrid circuits and waveguide-type polarization converters, the antenna feed circuit has a two dimensional structure, and is advantageous due to the ability to reduce thickness of the antenna feed circuit.

The antenna feed circuit of Embodiment 2 of the present disclosure is configured using the first through fourth waveguide-type hybrid circuits, the first through eighth waveguide-type polarization converters and the waveguides, which are passive elements, and thus reverse operation is possible, so that a high frequency signal is output from the second feed terminal when a clockwise circular rotation polarization high frequency signal enters the OMT 40, and a high frequency signal is output from the first feed terminal when a counterclockwise circular rotation polarization high frequency signal enters the OMT 40.

As long as the rotation direction of the polarization of the first waveguide-type polarization converter 4 is opposite to the rotation direction of the polarization of the second waveguide-type polarization converter 5, in order that the polarization of the high frequency signal entering the first waveguide-type polarization converter 4 becomes the same as the polarization of the high frequency signal output from the second waveguide-type polarization converter 5 in the antenna feed circuit of Embodiment 2 of the present disclosure, the order of rotation of the polarization may start with either clockwise rotation or with counterclockwise rotation. The relationship between the rotation directions of the polarization according to the third waveguide-type polarization converter 8 and the fourth waveguide-type polarization converter 9 is the same as the relationship between the rotation directions of the polarization according to the fifth waveguide-type polarization converter 13 and the sixth waveguide-type polarization converter 14.

With respect to the relationship between the eighth waveguide-type polarization converter 18 and the seventh waveguide-type polarization converter 17, as long as the directions of rotation of the polarization of the eighth waveguide-type polarization converter 18 and the seventh waveguide-type polarization converter 17 are the same so that the polarization of the high frequency signal output from the eighth waveguide-type polarization converter 18 is 180° reversed from the polarization of the high frequency signal fed to the seventh waveguide-type polarization converter 17, the rotation directions of the polarization may be clockwise or counterclockwise.

Embodiment 3

In Embodiment 1 and Embodiment 2 of the present disclosure, the angles of rotation of the polarization of the first waveguide-type polarization converter 4 through the eighth waveguide-type polarization converter 18 are set at 90°. However, these angles of rotation of the polarization are not restricted to 90°, as long as the absolute values of the angles of rotation of the first waveguide-type polarization converter 4 and the second waveguide-type polarization converter 5 are the same, and the rotation directions of the polarization are mutually opposite. For example, if the angle of rotation of the first waveguide-type polarization converter 4 is clockwise by 45°, the angle of rotation of the second waveguide-type polarization converter 5 may be counter-clockwise by 45°. The relationships of the angles of rotation and the rotation directions of the polarization of the third waveguide-type polarization converter 8 and the fourth waveguide-type polarization converter 9 are the same as the relationships of the angles of rotation and the rotation directions of the polarization of the fifth waveguide-type polarization converter 13 and the sixth waveguide-type polarization converter 14.

Moreover, there is no requirement for the absolute values of the angles of rotation of polarization of the first waveguide-type polarization converter 4 through the sixth waveguide-type polarization converter 14 to be the same, as long as the absolute values of angles of rotation of the polarization of the first waveguide-type polarization converter 4 and second waveguide-type polarization converter 5 pair are the same, the absolute values of angles of rotation of the polarization of the third waveguide-type polarization converter 8 and fourth waveguide-type polarization converter 9 pair are the same, and the absolute values of angles of rotation of the polarization of the fifth waveguide-type polarization converter 13 and sixth waveguide-type polarization converter 14 pair are the same.

Concerning the relationship between the seventh waveguide-type polarization converter 17 and eighth waveguide-type polarization converter 18, as long as the directions of rotation of the polarization of the seventh waveguide-type polarization converter 17 and eighth waveguide-type polarization converter 18 are the same, and the polarization of the high frequency signal output from the eighth waveguide-type polarization converter 18 is 180° reversed from the polarization of the high frequency signal input to the seventh waveguide-type polarization converter 17, there is no requirement for the absolute values of the rotation angles of the polarization of the seventh waveguide-type polarization converter 17 and eighth waveguide-type polarization converter 18 to be identical. For example, if the rotation angle of the polarization of the seventh waveguide-type polarization converter 17 is 45° clockwise, then the rotation angle of the polarization of the eighth waveguide-type polarization converter 18 may be 135° clockwise.

Figure 5:
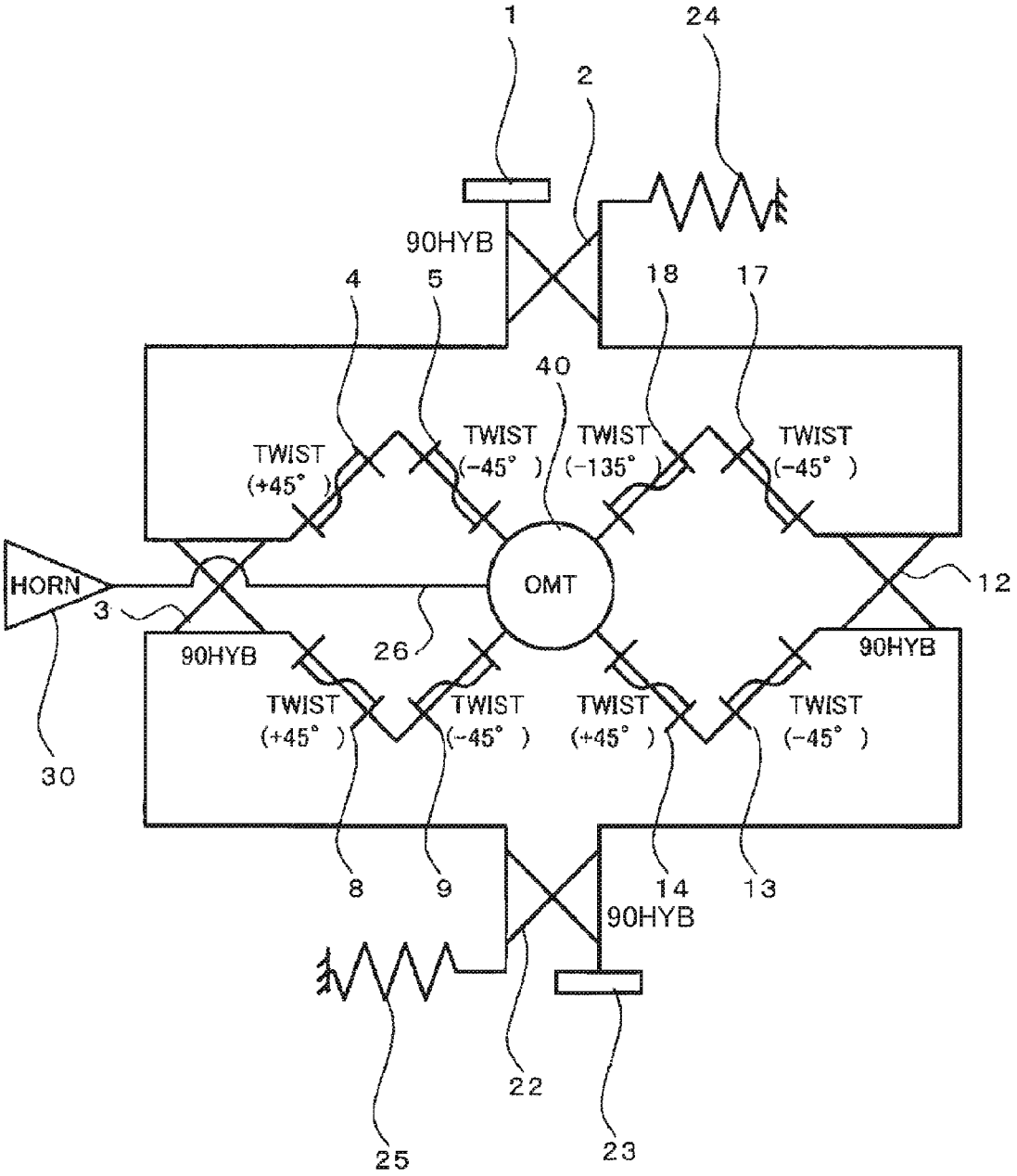
FIG. 5 is a circuit diagram of an antenna feed circuit according to Embodiment 3 of the present disclosure.

A circuit diagram of the antenna feed circuit of Embodiment 3 of the present disclosure is shown in FIG. 5, in which the absolute values of the angles of rotation of the polarization of the first waveguide-type polarization converter 4 through the seventh waveguide-type polarization converter 17 of the antenna feed circuit of Embodiment 2 of the present disclosure are set to 45°, and the absolute value of the angle of rotation of the polarization of the eighth waveguide-type polarization converter 18 is set to 135°. The operation of the antenna feed circuit of Embodiment 3 of the present disclosure is the same as that of the antenna feed circuit of Embodiment 2 of the present disclosure, except that the absolute values of the angles of rotation of the polarization of the first waveguide-type polarization converter 4 through the eighth waveguide-type polarization converter 18 differ from those of the antenna feed circuit of Embodiment 2 of the present disclosure.

Moreover, if the absolute value of the angles of rotation of the polarization of the first waveguide-type polarization converter 4 through the seventh waveguide-type polarization converter 17 are set to 45° and the absolute value of the angle of rotation of the polarization of the eighth waveguide-type polarization converter 18 is set to 135° in the antenna feed circuit of Embodiment 1 of the present disclosure, the antenna feed circuit is the same as that of Embodiment 1 of the present disclosure, except for the absolute values of the angles of rotation of the first waveguide-type polarization converter 4 through the eighth waveguide-type polarization converter 18 being different from those of the antenna feed circuit of Embodiment 1 of the present disclosure.

Furthermore, in Embodiment 1 through 3 of the present disclosure, the first waveguide-type hybrid circuit 2, second waveguide-type hybrid circuit 3, third waveguide-type hybrid circuit 12 and fourth waveguide-type hybrid circuit 22 may be either a branch-line type 90° waveguide-type hybrid circuit or a short-slot type 90° waveguide-type hybrid circuit.

REFERENCE SIGNS LIST

1 First feed terminal
2 First waveguide-type hybrid circuit
2*a* First terminal
2*b* Second terminal
2*c* Third terminal
2*d* Fourth terminal
3 Second waveguide-type hybrid circuit
3*a* First terminal
3*b* Second terminal
3*c* Third terminal
3*d* Fourth terminal
4 First waveguide-type polarization converter
5 Second waveguide-type polarization converter
6 Waveguide
7 Waveguide-type low pass filter
8 Third waveguide-type polarization converter
9 Fourth waveguide-type polarization converter
10 Waveguide
11 Waveguide-type low pass filter
12 Third waveguide-type hybrid circuit
12*a* First terminal
12*b* Second terminal
12*c* Third terminal
12*d* Fourth terminal
13 Fifth waveguide-type polarization converter
14 Sixth waveguide-type polarization converter
15 Waveguide
16 Waveguide-type low pass filter
17 Seventh waveguide-type polarization converter
18 Eighth waveguide-type polarization converter
19 Waveguide
20 Waveguide-type low pass filter
21 Waveguide group branching filter (OMJ, main waveguide)
21*a* First branch terminal
21*b* Second branch terminal
21*c* Third branch terminal
21*d* Fourth branch terminal
22 Fourth waveguide-type hybrid circuit
22*a* First terminal
22*b* Second terminal
22*c* Third terminal
22*d* Fourth terminal
23 Second feed terminal
24, 25 Terminating resistor
26 Main waveguide
30 Horn antenna
40 Orthogonal polarized wave separator (OMT, main waveguide)
40*a* First branch terminal
40*b* Second branch terminal
40*c* Third branch terminal

**40*d*** Fourth branch terminal

The invention claimed is:

1. An antenna feed circuit, comprising:

a first feed terminal;

a first waveguide-type hybrid circuit comprising a first waveguide-type hybrid circuit first terminal to connect to the first feed terminal, a first waveguide-type hybrid circuit second terminal to output a high frequency signal of a reference phase, and a first waveguide-type hybrid circuit third terminal to output the high frequency signal of 90° lagging phase from that of the high frequency signal of the second terminal at a transmission frequency;

a second waveguide-type hybrid circuit comprising a second waveguide-type hybrid circuit first terminal to connect to the first waveguide-type hybrid circuit second terminal, a second waveguide-type hybrid circuit second terminal to output the high frequency signal of the reference phase, and a second waveguide-type hybrid circuit third terminal to output the high frequency signal of 90° lagging phase from that of the high frequency signal of the second waveguide-type hybrid circuit second terminal at the transmission frequency;

a pair of first and second waveguide-type polarization converters to receive as input the high frequency signal from the second waveguide-type hybrid circuit second terminal, and to output the high frequency signal at the transmission frequency with a polarization oriented the same as the polarization of the input high frequency signal, by rotation of the polarization at the same angle in mutually opposite directions;

a pair of third and fourth waveguide-type polarization converters to receive as input the high frequency signal from the second waveguide-type hybrid circuit third terminal, and to output the high frequency signal at the transmission frequency with the polarization oriented the same as the polarization of the input high frequency signal, by rotation of the polarization at the same angle in mutually opposite directions;

a third waveguide-type hybrid circuit comprising a third waveguide-type hybrid circuit first terminal to connect to the first waveguide-type hybrid circuit third terminal, a third waveguide-type hybrid circuit second terminal to output the high frequency signal of the reference phase, and a third waveguide-type hybrid circuit third terminal to output the high frequency signal of 90° lagging phase from that of the high frequency signal of the third waveguide-type hybrid circuit second terminal at the transmission frequency;

a pair of fifth and sixth waveguide-type polarization converters to receive as input the high frequency signal from the third waveguide-type hybrid circuit third terminal, and to output the high frequency signal at the transmission frequency with the polarization oriented the same as the polarization of the input high frequency signal, by rotation of the polarization at the same angle in mutually opposite directions;

a pair of seventh and eighth waveguide-type polarization converters to receive as input the high frequency signal from the third waveguide-type hybrid circuit second terminal, and to output the high frequency signal at the transmission frequency with the polarization reversed in orientation from that of the polarization of the input high frequency signal, by rotation of the polarization in the same direction; and a main waveguide comprising:

a first branch terminal to receive as input the high frequency signal from the pair of the first and second waveguide-type polarization converters, a second branch terminal to receive as input the high frequency signal from the pair of the third and fourth waveguide-type polarization converters, a third branch terminal to receive as input the high frequency signal from the pair of the fifth and sixth waveguide-type polarization converters, a fourth branch terminal to receive as input the high frequency signal from the pair of the seventh and eighth waveguide-type polarization converters, wherein the first branch terminal is adjacent to, and has a phase differential of 90° relative to, each of the second branch terminal and the fourth branch terminal;

the second branch terminal is adjacent to, and has a phase differential of 90° relative to, each of the third branch terminal and the first branch terminal;

the third branch terminal is adjacent to, and has a phase differential of 90° relative to, each of the fourth branch terminal and the second branch terminal; and the fourth branch terminal is adjacent to, and has a phase differential of 90° relative to, each of the first branch terminal and the third branch terminal.

2. The antenna feed circuit according to claim 1, wherein the rotation angle of the polarization of the first waveguide-type polarization converter, the second waveguide-type polarization converter, the third waveguide-type polarization converter, the fourth waveguide-type polarization converter, the fifth waveguide-type polarization converter, the sixth waveguide-type polarization converter, the seventh waveguide-type polarization converter and the eighth waveguide-type polarization converter is 90°.

3. The antenna feed circuit according to claim 1, wherein the pair of the first and second waveguide-type polarization converters includes a first waveguide-type polarization converter to receive as input the high frequency signal from the second waveguide-type hybrid circuit second terminal, and to output the high frequency signal at the transmission frequency with the polarization rotated by a first angle in one direction; and a second waveguide-type polarization converter to receive as input the high frequency signal from the first waveguide-type polarization converter, and to output the high frequency signal at the transmission frequency with the polarization rotated by the first angle in another direction, opposite to the one direction, the pair of the third and fourth waveguide-type polarization converters includes a third waveguide-type polarization converter to receive as input the high frequency signal from the second waveguide-type hybrid circuit third terminal, and to output the high frequency signal at the transmission frequency with the polarization rotated by a second angle in the one direction; and a fourth waveguide-type polarization converter to receive as input the high frequency signal from the third waveguide-type polarization converter, and to output the high frequency signal at the transmission frequency with the polarization rotated by the second angle in the other direction, the pair of the fifth and sixth waveguide-type polarization converters includes a fifth waveguide-type polarization converter to receive as input the high frequency signal from the third waveguide-type hybrid circuit third terminal, and to output the high frequency signal at the transmission frequency with the polarization rotated by a third angle in the one direction; and a sixth waveguide-type polarization converter to receive as input the high frequency signal from the fifth waveguide-type polarization converter, and to output the high frequency signal at the transmission frequency with the polarization rotated by the third angle in the other direction, the pair of the seventh and eighth waveguide-type polarization converters includes a seventh waveguide-type polarization converter to receive as input the high frequency signal from the third waveguide-type hybrid circuit second terminal, and to output the high frequency signal at the transmission frequency with the polarization rotated by a fourth angle in the other direction; and an eighth waveguide-type polarization converter to receive as input the high frequency signal from the seventh waveguide-type polarization converter, and to output the high frequency signal at the transmission frequency with the polarization rotated by an angle that is a difference between 180° and the fourth angle, in the other direction, the main waveguide first branch terminal receives as input the high frequency signal output from the second waveguide-type polarization converter of the pair of the first and second waveguide-type polarization converters, the main waveguide second branch terminal receives as input the high frequency signal output from the fourth waveguide-type polarization converter of the pair of the third and fourth waveguide-type polarization converters, the main waveguide third branch terminal receives as input the high frequency signal output from the sixth waveguide-type polarization converter of the pair of the fifth and sixth waveguide-type polarization converters, and the main waveguide fourth branch terminal receives as input the high frequency signal output from the eighth waveguide-type polarization converter of the pair of the seventh and eighth waveguide-type polarization converters.

4. The antenna feed circuit according to claim 3, wherein each of the first angle, second angle, third angle and fourth angle is 90°.

5. The antenna feed circuit according to claim 1, wherein the main waveguide further comprises a waveguide group branching filter.

6. The antenna feed circuit according to claim 1, wherein the main waveguide further comprises an orthogonal polarized wave separator.

7. An antenna feed circuit, comprising:

a second feed terminal;

a fourth waveguide-type hybrid circuit comprising a fourth waveguide-type hybrid circuit first terminal to connect to the second feed terminal, a fourth waveguide-type hybrid circuit second terminal to output a high frequency signal of a reference phase, and a fourth waveguide-type hybrid circuit third terminal to output the high frequency signal of 90° lagging phase from that of the high frequency signal of the fourth waveguide-type hybrid circuit second terminal at a transmission frequency;

a third waveguide-type hybrid circuit comprising a third waveguide-type hybrid circuit fourth terminal to connect to the fourth waveguide-type hybrid circuit second terminal, a third waveguide-type hybrid circuit third terminal to output the high frequency signal of the reference phase, and a third waveguide-type hybrid circuit second terminal to output the high frequency signal of 90° lagging phase from that of the high frequency signal of the third waveguide-type hybrid circuit third terminal at the transmission frequency;

a pair of fifth and sixth waveguide-type polarization converters to receive as input the high frequency signal from the third waveguide-type hybrid circuit third terminal, and to output the high frequency signal at the transmission frequency with a polarization oriented the same as the polarization of the input high frequency signal, by rotation of the polarization at the same angle in mutually opposite directions;

a pair of seventh and eighth waveguide-type polarization converters to receive as input the high frequency signal from the third waveguide-type hybrid circuit second terminal, and to output the high frequency signal at the transmission frequency with the polarization reversed in orientation from that of the polarization of the input high frequency signal, by rotation of the polarization in the same direction;

a second waveguide-type hybrid circuit comprising a second waveguide-type hybrid circuit fourth terminal to connect to the fourth waveguide-type hybrid circuit third terminal, a second waveguide-type hybrid circuit third terminal to output the high frequency signal of the reference phase, and a second waveguide-type hybrid circuit second terminal to output the high frequency signal of 90° lagging phase from that of the high frequency signal of the second waveguide-type hybrid circuit third terminal at the transmission frequency;

a pair of first and second waveguide-type polarization converters to receive as input the high frequency signal from the second waveguide-type hybrid circuit second terminal, and to output the high frequency signal at the transmission frequency with the polarization oriented the same as the polarization of the input high frequency signal, by rotation of the polarization at the same angle in mutually opposite directions;

a pair of third and fourth waveguide-type polarization converters to receive as input the high frequency signal from the second waveguide-type hybrid circuit third terminal, and to output the high frequency signal at the transmission frequency with the polarization oriented the same as the polarization of the input high frequency signal, by rotation of the polarization at the same angle in mutually opposite directions; and a main waveguide comprising:

a third branch terminal to receive as input the high frequency signal from the pair of the fifth and sixth waveguide-type polarization converters, a second branch terminal to receive as input the high frequency signal from the pair of the third and fourth waveguide-type polarization converters, a first branch terminal to receive as input the high frequency signal from the pair of the first and second waveguide-type polarization converters, and a fourth branch terminal to receive as input the high frequency signal from the pair of the seventh and eighth waveguide-type polarization converters, wherein the first branch terminal is adjacent to, and has a phase differential of 90° relative to, each of the second branch terminal and the fourth branch terminal;

the second branch terminal is adjacent to, and has a phase differential of 90° relative to, each of the third branch terminal and the first branch terminal;

the third branch terminal is adjacent to, and has a phase differential of 90° relative to, each of the fourth branch terminal and the second branch terminal; and the fourth branch terminal is adjacent to, and has a phase differential of 90° relative to, each of the first branch terminal and the third branch terminal.

8. The antenna feed circuit according to claim 7, wherein the rotation angle of the polarization of the first waveguide-type polarization converter, the second waveguide-type polarization converter, the third waveguide-type polarization converter, the fourth waveguide-type polarization converter, the fifth waveguide-type polarization converter, the sixth waveguide-type polarization converter, the seventh waveguide-type polarization converter and the eighth waveguide-type polarization converter is 90°.

9. The antenna feed circuit according to claim 7, wherein the pair of the fifth and sixth waveguide-type polarization converters includes a fifth waveguide-type polarization converter to receive as input the high frequency signal from the third waveguide-type hybrid circuit third terminal, and to output the high frequency signal at the transmission frequency with the polarization rotated by a third angle in one direction; and a sixth waveguide-type polarization converter to receive as input the high frequency signal from the fifth waveguide-type polarization converter, and to output the high frequency signal at the transmission frequency with the polarization rotated by the third angle in another direction opposite to the one direction, the pair of the seventh and eighth waveguide-type polarization converters includes a seventh waveguide-type polarization converter to receive as input the high frequency signal from the third waveguide-type hybrid circuit second terminal, and to output the high frequency signal at the transmission frequency with the polarization rotated by a fourth angle in the other direction; and an eighth waveguide-type polarization converter to receive as input the high frequency signal from the seventh waveguide-type polarization converter, and to output the high frequency signal at the transmission frequency with the polarization rotated by an angle that is a difference between 180° and the fourth angle, in the other direction, the pair of the first and second waveguide-type polarization converters includes a first waveguide-type polarization converter to receive as input the high frequency signal from the second waveguide-type hybrid circuit second terminal, and to output the high frequency signal at the transmission frequency with the polarization rotated by a first angle in the one direction; and a second waveguide-type polarization converter to receive as input the high frequency signal from the first waveguide-type polarization converter, and to output the high frequency signal at the transmission frequency with the polarization rotated by the first angle in the other direction, the pair of the third and fourth waveguide-type polarization converters includes a third waveguide-type polarization converter to receive as input the high frequency signal from the second waveguide-type hybrid circuit third terminal, and to output the high frequency signal at the transmission frequency with the polarization rotated by a second angle in the one direction; and a fourth waveguide-type polarization converter to receive as input the high frequency signal from the third waveguide-type polarization converter, and to output the high frequency signal at the transmission frequency with the polarization rotated by the second angle in the other direction, the main waveguide third branch terminal receives as input the high frequency signal output from the sixth waveguide-type polarization converter of the pair of the fifth and sixth waveguide-type polarization converters, the main waveguide second branch terminal receives as input the high frequency signal output from the fourth waveguide-type polarization converter of the pair of the third and fourth waveguide-type polarization converters, the main waveguide first branch terminal receives as input the high frequency signal output from the second waveguide-type polarization converter of the pair of the first and second waveguide-type polarization converters, and the main waveguide fourth branch terminal receives as input the high frequency signal output from the eighth waveguide-type polarization converter of the pair of the seventh and eighth waveguide-type polarization converters.

10. The antenna feed circuit according to claim 9, wherein each of the first angle, second angle, third angle and fourth angle is 90°.

11. The antenna feed circuit according to claim 7, wherein the main waveguide further comprises a waveguide group branching filter.

12. The antenna feed circuit according to claim 7, wherein the main waveguide further comprises an orthogonal polarized wave separator.

* * * * *